US007921613B2

(12) United States Patent
Nii

(10) Patent No.: US 7,921,613 B2
(45) Date of Patent: Apr. 12, 2011

(54) TERRACED STRUCTURED LAND JOINT AND ASSEMBLY SYSTEM

(76) Inventor: Koichi Paul Nii, Oakland, CA (US)

( * ) Notice: Subject to any disclaimer, the term of this patent is extended or adjusted under 35 U.S.C. 154(b) by 477 days.

(21) Appl. No.: 12/137,116

(22) Filed: Jun. 11, 2008

(65) Prior Publication Data

US 2009/0311053 A1 Dec. 17, 2009

(51) Int. Cl.
*E04B 1/00* (2006.01)

(52) U.S. Cl. ..... 52/169.1; 52/655.1; 52/223.1; 52/81.3; 52/234

(58) Field of Classification Search ..... 52/81.2, 52/81.3, 655.1, 655.2, 169.3, 169.4, 169.1, 52/182, 234, 223.1, 223.13, 223.14, 291, 52/653.2; 403/122–144; 405/284
See application file for complete search history.

(56) References Cited

U.S. PATENT DOCUMENTS

| | | | | | |
|---|---|---|---|---|---|
| 111,453 | A | * | 1/1871 | Mason et al. | 135/74 |
| 1,833,649 | A | * | 11/1931 | Kartvelichvili et al. | 244/123.4 |
| 2,929,473 | A | * | 3/1960 | Lindsay | 52/654.1 |
| 3,418,768 | A | * | 12/1968 | Bernhard | 52/167.1 |
| 3,632,147 | A | * | 1/1972 | Finger | 403/171 |
| 3,685,221 | A | * | 8/1972 | Mangan | 52/80.1 |
| 3,864,049 | A | * | 2/1975 | Ono | 403/171 |
| 3,882,650 | A | * | 5/1975 | Gugliotta | 52/223.12 |
| 3,942,291 | A | * | 3/1976 | Hirata et al. | 52/169.4 |
| 4,027,449 | A | * | 6/1977 | Alcalde Cilveti | 52/655.2 |
| 4,457,118 | A | | 7/1984 | Bowen | |
| 4,562,682 | A | * | 1/1986 | Arvedi et al. | 52/655.1 |
| 4,566,246 | A | * | 1/1986 | Sanger | 52/655.1 |
| 4,624,090 | A | | 11/1986 | Stienen | |
| 4,637,193 | A | * | 1/1987 | Lange | 52/655.1 |
| 4,648,223 | A | * | 3/1987 | Richard | 52/223.8 |
| 4,677,804 | A | | 7/1987 | Holt | |
| 4,796,389 | A | * | 1/1989 | Bini et al. | 52/2.26 |
| 4,819,399 | A | | 4/1989 | Onoda | |
| 4,905,443 | A | * | 3/1990 | Sutcliffe et al. | 52/655.2 |
| 5,051,019 | A | | 9/1991 | Kohl | |
| 5,088,852 | A | | 2/1992 | Davister | |
| 5,341,611 | A | | 8/1994 | Lewis | |
| 5,399,043 | A | | 3/1995 | Plumeyer | |
| 5,568,993 | A | | 10/1996 | Potzick | |
| 5,626,434 | A | | 5/1997 | Cook | |
| 5,632,129 | A | | 5/1997 | Imai et al. | |
| 5,718,090 | A | * | 2/1998 | Wei-Hwang | 52/223.14 |
| 6,108,984 | A | | 8/2000 | Davidson | |
| 6,887,009 | B1 | | 5/2005 | Lopez | |
| 7,024,834 | B2 | | 4/2006 | Gimpel et al. | |
| 2003/0101663 | A1 | * | 6/2003 | Boots | 52/81.3 |
| 2006/0112657 | A1 | | 6/2006 | Abbot-Wilcox | |
| 2010/0083605 | A1 | * | 4/2010 | Wallner | 52/655.1 |

* cited by examiner

*Primary Examiner* — Robert J Canfield
*Assistant Examiner* — Babajide Demuren
(74) *Attorney, Agent, or Firm* — Charles L. Thoeming

(57) ABSTRACT

Terraced structured land joint and assembly system is disclosed, and includes a plurality of ball joints, each providing monolithic anchors for a plurality of compression and tension members. Tension members reside within compression members. Compression/tension members are linked between ball joints by couplers and turnbuckles, defining structured land including planar space frames, horizontal truss members, and vertical truss members. Structural forces are transferred through the ball joints into horizontal and vertical truss members, with resultant loads transferred to the ground.

19 Claims, 14 Drawing Sheets

TERRACED STRUCTURED LAND JOINT AND ASSEMBLY SYSTEM

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention relates to structured land and the replaceable framing parts necessary for such structures and, more particularly, to the use of a joint and assembly system for terraced structured land, the system combining separate members for tension and compression forces into an integrated assembly member.

2. Description of the Related Art including Information Disclosed Under 37 C.F.R. 1.97 and 1.98

A search of the prior art located the following United States patents and patent publications which are believed to be representative of the present state of the prior art: U.S. Pat. No. 6,887,099, issued May 3, 2005; U.S. Pat. No. 6,088,852, issued Feb. 18, 1992; U.S. Pat. No. 4,677,804, issued Jul. 7, 1987; U.S. Pat. No. 6,108,984, issued Aug. 29, 2000; U.S. Pat. No. 5,626,434, issued May 6, 1997; U.S. Pat. No. 4,624,090, issued Nov. 25, 1986; U.S. Pat. No. 5,399,043, issued Mar. 21, 1995; U.S. Pat. No. 5,632,129, issued May 27, 1997; U.S. Pat. No. 4,819,399, issued Apr. 11, 1989; U.S. Pat. No. 5,051,019, issued Sep. 24, 1991; U.S. Pat. No. 5,568,993, issued Oct. 29, 1996; U.S. Pat. No. 7,024,834, issued Apr. 11, 2006; U.S. Patent Publication No. 1006/0112657, published Jun. 1, 2006; U.S. Pat. No. 5,341,611, issued Aug. 30, 1994; and U.S. Pat. No. 4,457,118, issued Jul. 3, 1984.

BRIEF SUMMARY OF THE INVENTION

Terraced structural framing concepts encompass vertical and horizontal elements, and are best achieved using structured land that implements efficient use of unused land, such as land with weak stratum soil, slopes, and the dead air space of overcrowded cities, by making use of the air space above and in it.

Horizontal or planar structured land provides space where all activities take place; the ultimate form of which is the earth's surface. Proposed horizontal structured land platforms are placed one above the other in a stair like manner, terminating in a terraced mountain shape. These horizontal terraces are supported by vertical elements which transfer all loads to the ground.

Unlike most all structures which are built having a life span of effective functional use, terraced structural framing, like earth's surface, must function for a much longer time period. Thus, these structures must be constructed to be both adaptable and economical. In the near future, with building materials possibly using nano-technology, they may be self-sustaining. Until such time, today's technology must be implemented.

Thus, three-dimension efficient use of these unused spaces will address future overcrowding issues and would accelerate development to satisfy the following requirements: 1) ensure the flexibility necessary to accommodate quick changes in urban structures; 2) offer a variety of sizes, shapes or compositions and to readily apply to all types of use by setting a standardized variety of structural components; 3) ensure that every structural component with multiple component functions can be cheaply mass-produced in large quantities in the future; 4) ensure that fabrication and demolition of components can be achieved quickly and mechanically without posing problems of danger, noise, and vibration to areas adjacent to the construction site; 5) ensure safety in the event of natural or other disasters; 6) ensure that for the modularization of such necessary urban equipment systems as power supply, waste disposal-treatment, and information systems, that a terminal circuit net can be installed by compounding them and that such systems can be quickly fabricated as components to the highest possible degree; 7) ensure that systems for efficient use of energy and resources can be installed; 8) provide a structure that can cope with the distribution of traffic and materials; 9) provide an excellent living environment by planting trees on all levels, and to provide such mental comforts such as insulation, ventilation, soundproofing and privacy; 10) provide a constructed structure affording sufficient strength as an urban structure; and 11) reuse of resources must be possible after demolition.

The solution to achieve these requirements must also satisfy all of the following general assembly, maintenance, and disassembly criteria: a) structures constructed of materials readily available; b) structures made of components easily transportable; c) structures made of components easy to assemble and disassemble; and d) structural components replaceable without disruption to the structural system and the life activities of inhabitants of the structural system.

The best known solution to meet all these criteria are framing systems consisting of trusses. For the horizontal platform, a space frame is used. Truss columns and beams transfer the space frame loads to the ground. Truss members typically are modular length chords and associated connecting joints. For space framing, there are two members. For beams and columns there are three members. For the connection between space frame and beams or columns, joints are required. One type of joint is used for platforms or horizontal surface elements; another joint is used for the vertical elements. The efficiency of these structures is enhanced when tension members are inside compression members.

Many truss based connectors for variable space frame structural systems have been developed. In total, these systems have limitations as to one or more of the necessary criteria for terraced structural framing systems using known construction materials. Similarly, these known systems do not lend themselves to be self-sustaining with future construction materials.

Accordingly, it is desirable to provide a truss joint and assembly system with tension and compression members integrated into the same connector element between each joint.

It is a further objective to provide a truss joint and assembly system which can be quickly constructed from known materials without the necessity of welding or other specialized construction trades.

It is yet a further objective to provide a truss joint and assembly system easily assembled and disassembled, and maintainable without disruption to the life activities of inhabitants.

A further objective is to provide a truss joint and assembly system which can be easily assembled without the necessity of advanced training or specialized knowledge.

Finally, it is an objective to provide a truss joint and assembly system the components of which are easily transportable to a point of assembly.

The terraced structured land joint and assembly system is directed to a such an efficient and affordable structural system and method for constructing terraced structural framing of any scale. Joints are used to provide space framing and truss columns and beams, and to connect the two systems. All framing members between joints have tension members within compression members. These intermediary framing members combine internal couplers and turnbuckles and external couplers to transfer compressive or load forces to or from the joint. As such, space framing members support horizontal platforms. Truss columns and beams transfer the space frame loads to the ground.

Other features, advantages, and objects of the present invention will become apparent with reference to the following description and accompanying drawings.

BRIEF DESCRIPTION OF DRAWINGS

FIG. 9B is an expanded view of the portion of FIG. 9 not shown in FIG. 9A.

DETAILED DESCRIPTION OF THE INVENTION

The following detail description of exemplary embodiments of the terraced structured land joint and assembly wherein reference numbers for the same and similar elements are carried forward throughout the various drawing figures. It is understood and should be noted that the figures are not drawn to any particular scale and are provided herein principally for illustrative purposes only.

Figure 1:
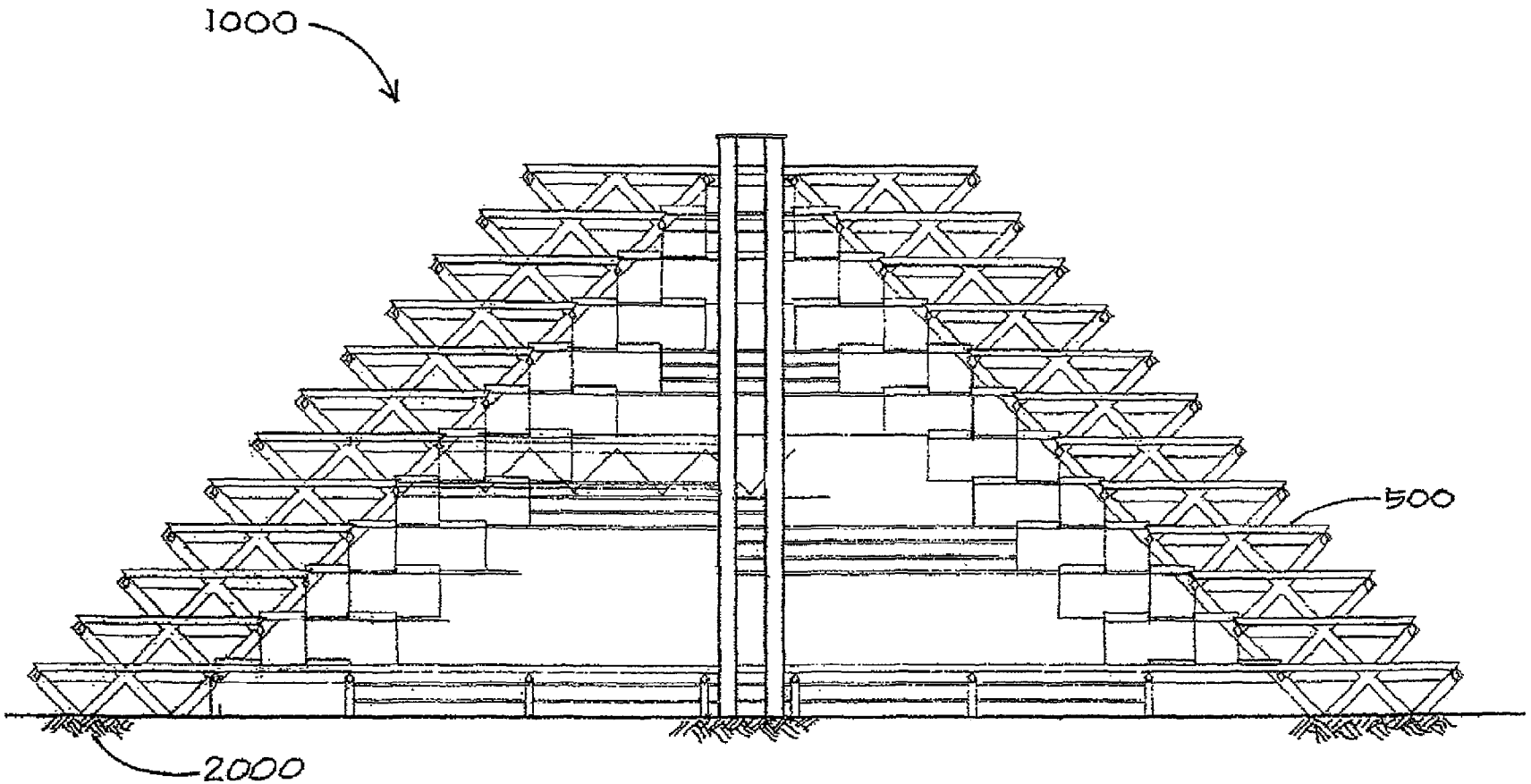
FIG. 1 is a side elevation view of representative structured land 1000 including a plurality of modules 500 constructed from an embodiment of the terraced structured land joint and assembly system.

The preferred embodiment of structured land using the terraced structured land joint and assembly is the mountain, FIG. 1. The structured land of FIG. 1 can change; it can grow; and, it can transform. Using a computer world analogy where the terraced mountain is "hardware," all structures and building spaces created on and inside the terraced mountain are "software." With the terraced structured land joint and assembly disclosed above, the software can be added without sequential staging as present construction practices require. Further, all components of the terraced structured land joint and assembly can be built in factories, easily transported to the job site, and assembled without training or extensive knowledge of construction trades. Construction time is greatly reduced. Weather or seasonal considerations would not dictate construction scheduling.

Figure 6:
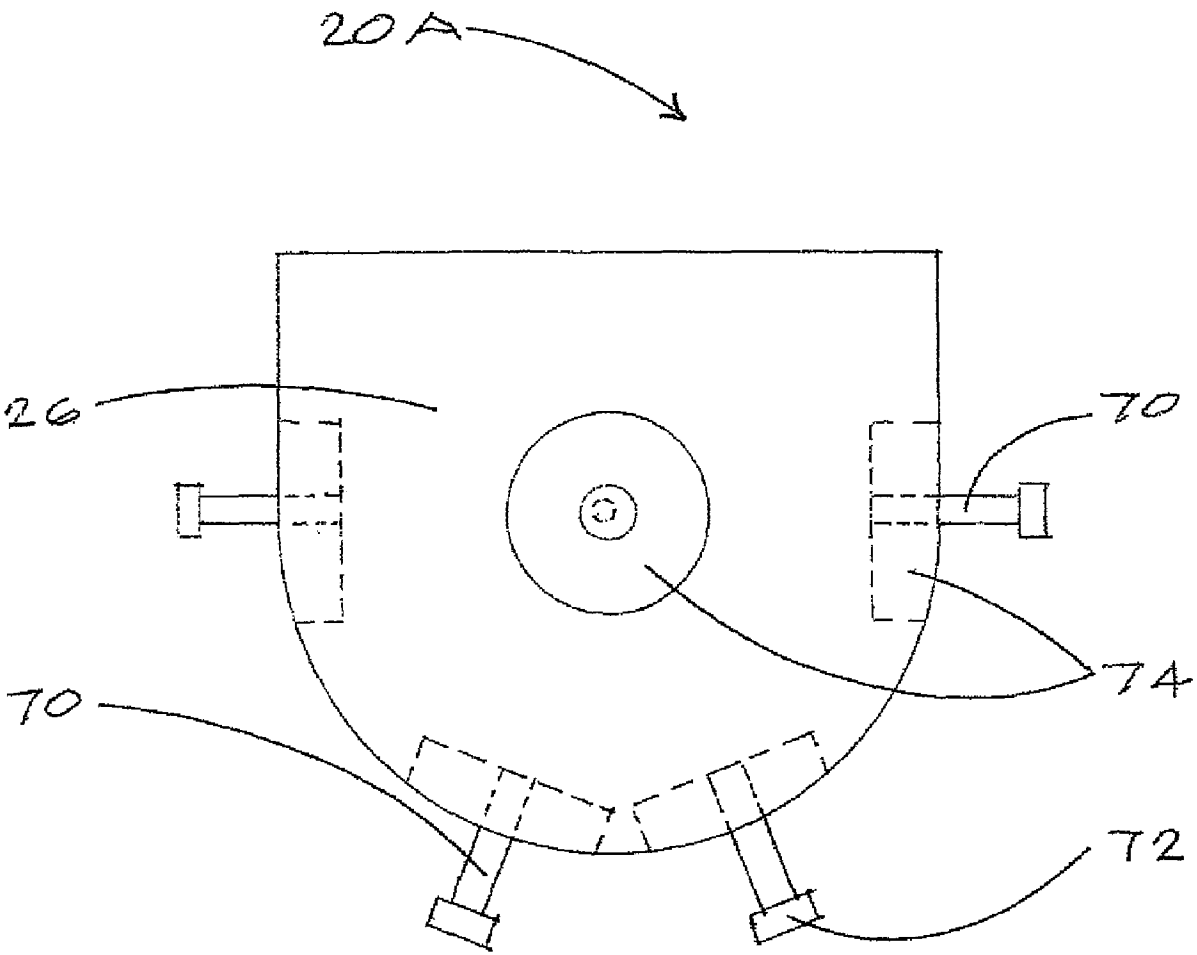
FIG. 6 is a side view of an embodiment of ball joint 20A with a plurality of mortises 74 (sockets) and including a plurality monolithic tension members 70 each within a mortise 74.
Figures 7, 8:
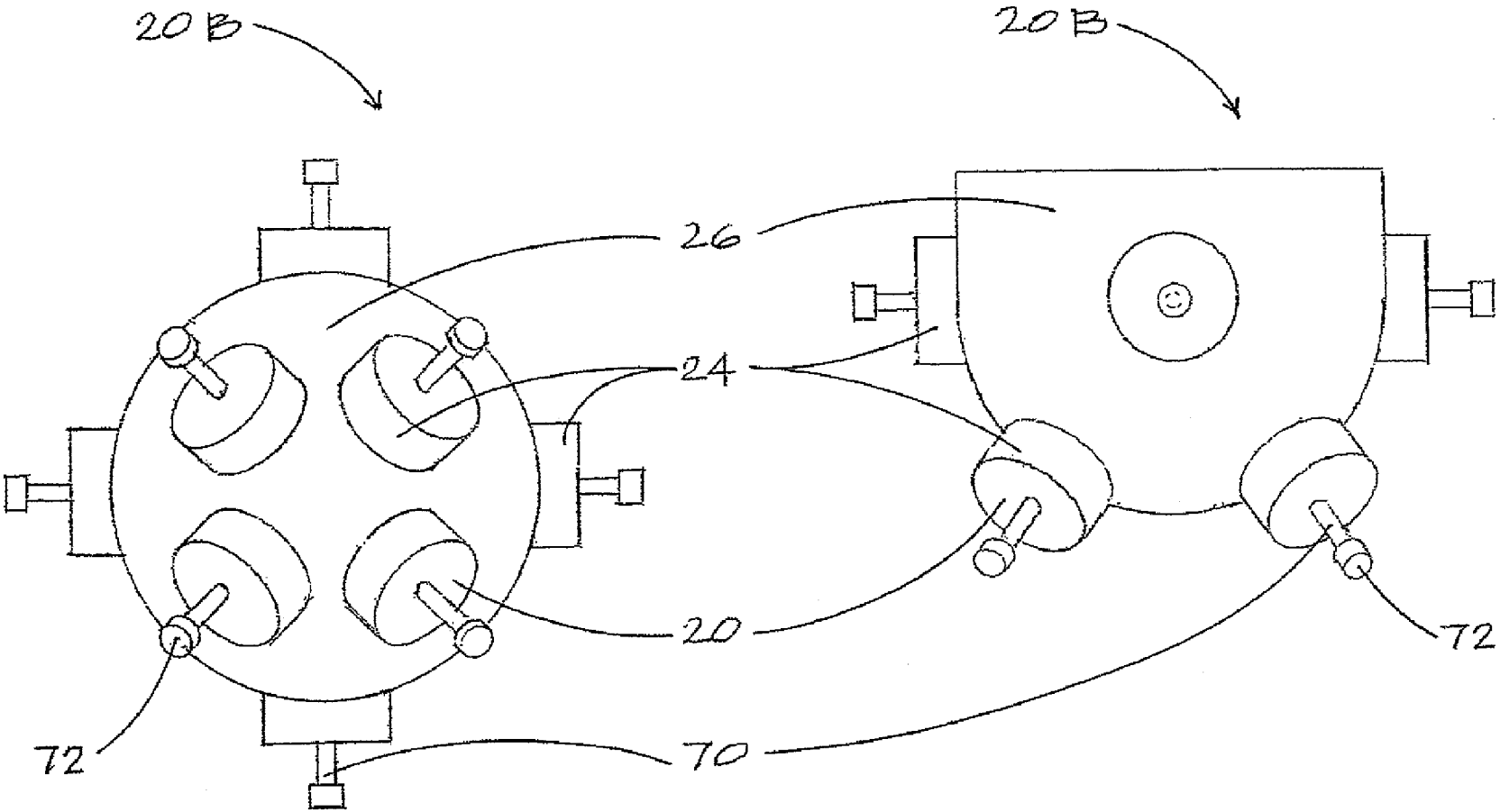
FIG. 7 is a top view of an embodiment of ball joint 20B with a plurality of compression tenons 22 (stubs, nodes) and including a plurality monolithic tension members 70 each centered on a ball joint compression tenon 24.
FIG. 8 is a side view of the ball joint 20B of FIG. 7, and including a plurality monolithic tension members 70 each centered on a ball joint compression tenon 24.
Figure 9:
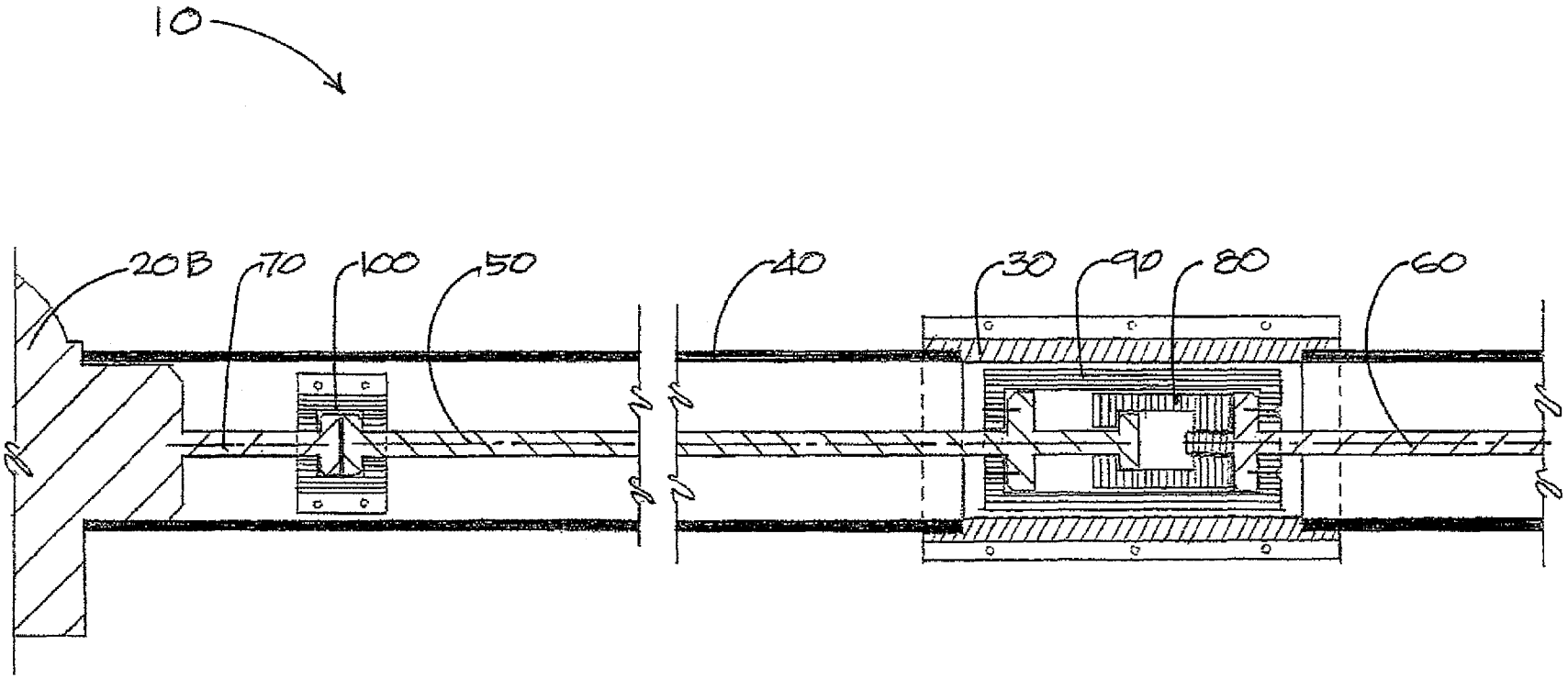
FIG. 9 is a cut away view A - A of FIG. 5 depicting an interlinking tension/compression member 10 connected to the ball joint 20B of FIG. 7.
Figure 9A:
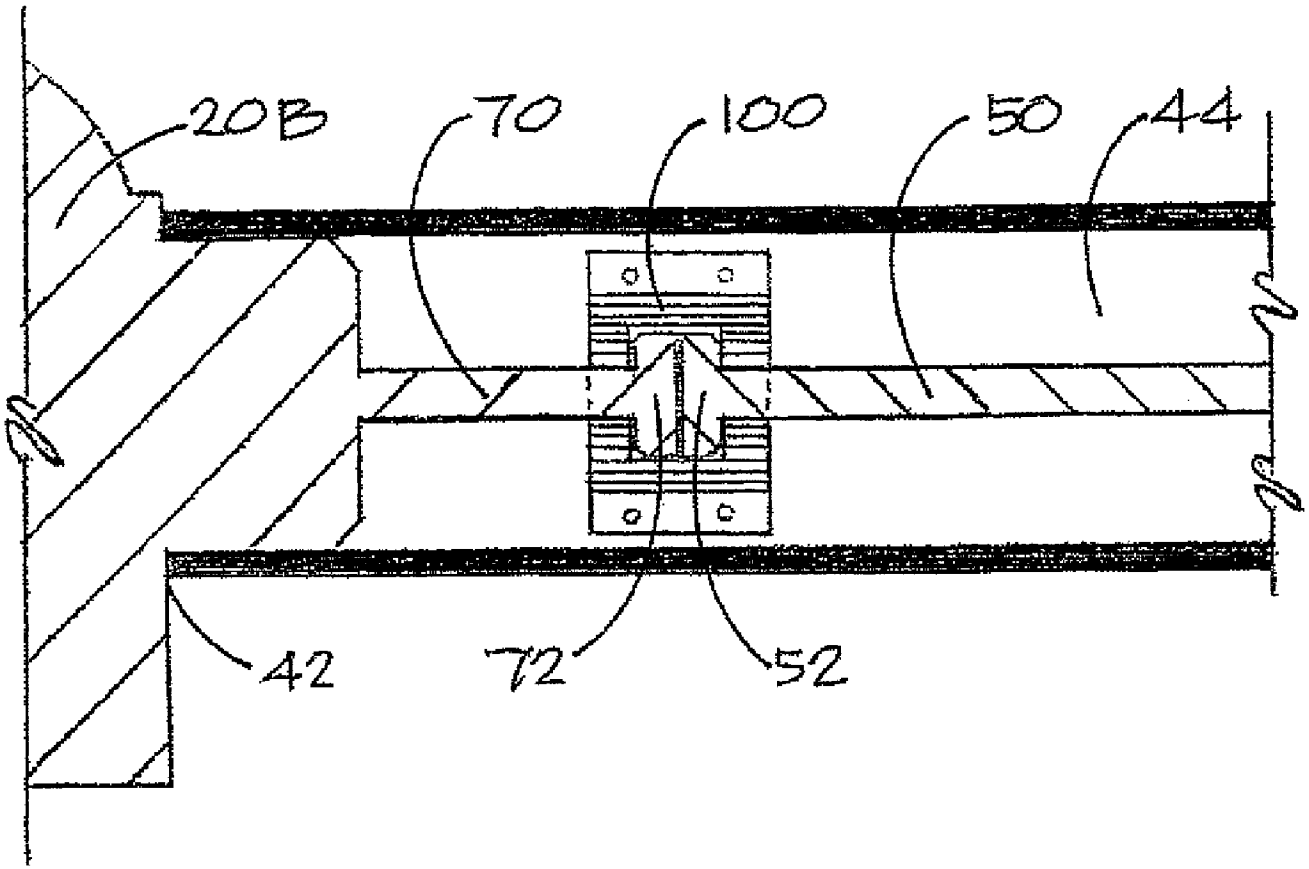
FIG. 9A is an expanded view of a portion of FIG. 9.
Figure 7B:
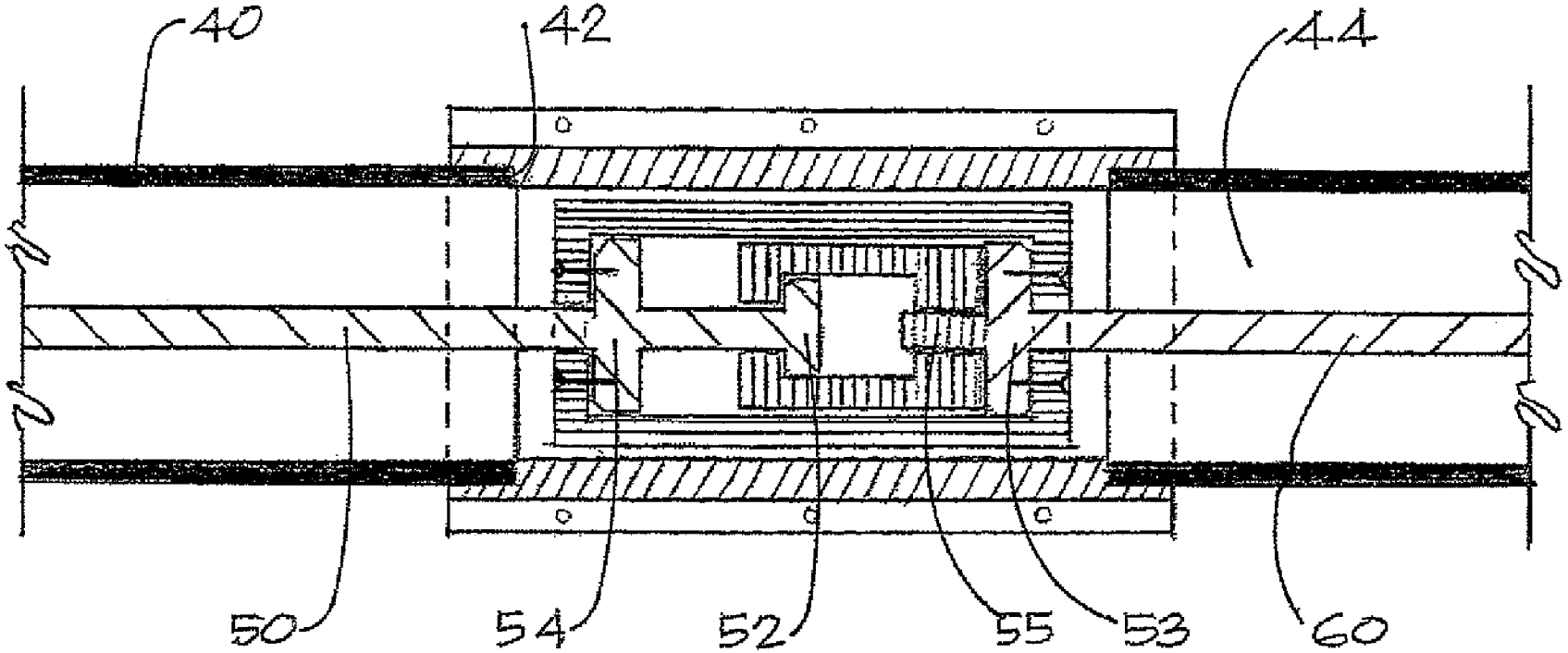
Figure 10A:
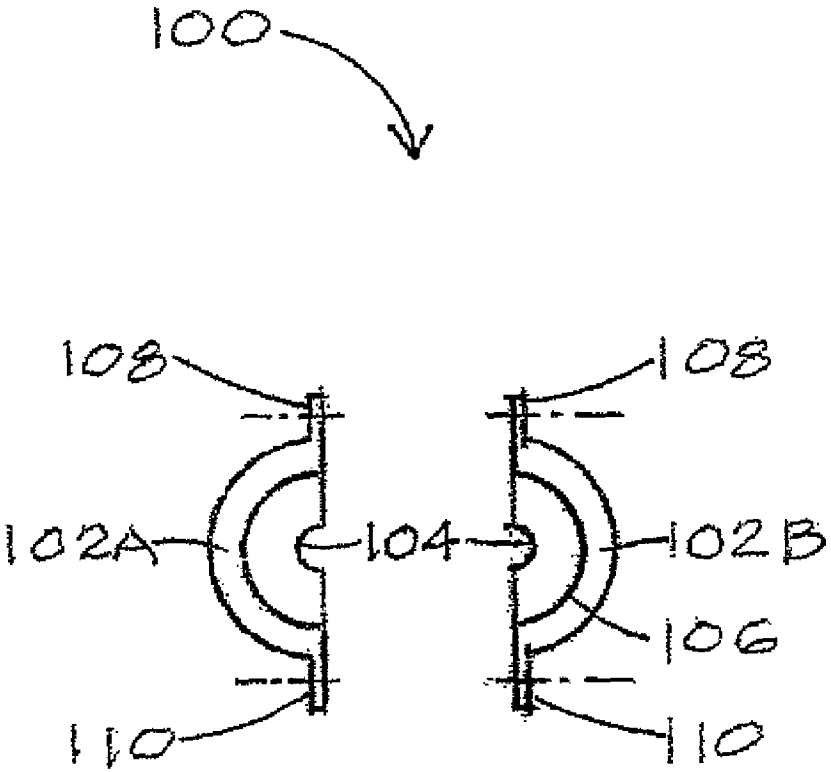
FIG. 10A is an exploded end view of the tension coupler 100 of FIG. 10 including two equal sized split annular flange portions 102A and 102B.
Figure 10:
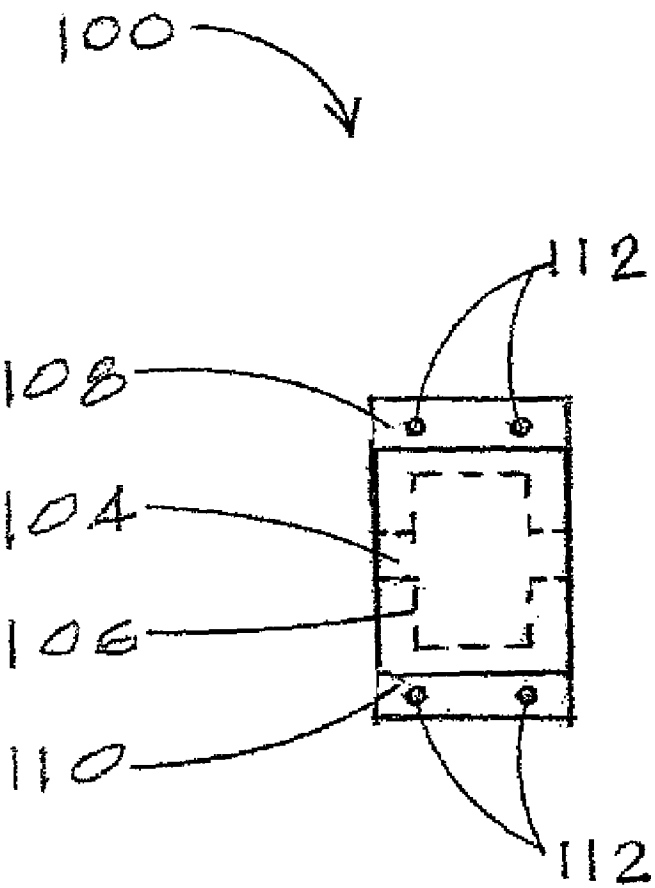
FIG. 10 is a side elevation view of a tension coupler 100 of the interlinking tension/compression member 10 of FIG. 9.
Figure 11A:
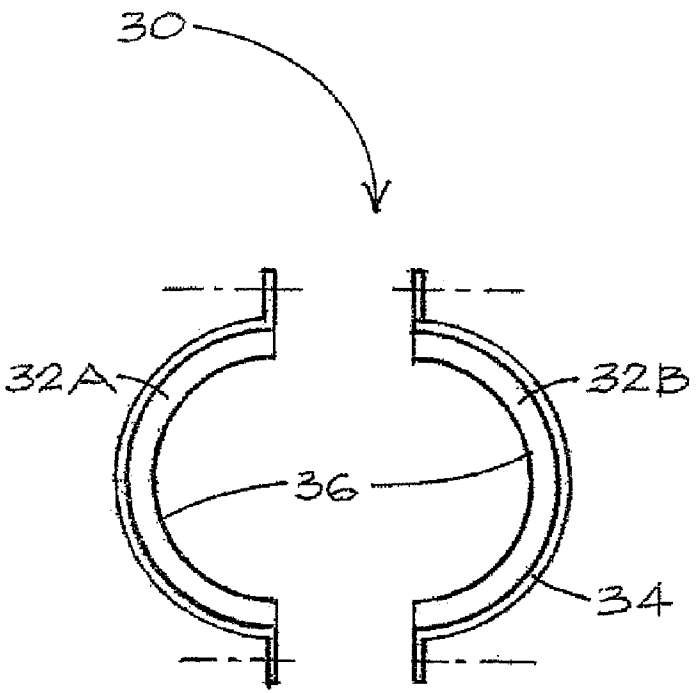
FIG. 11A is an exploded end view of the compression coupler 30 of FIG. 11 including two equal sized split annular flange portions 32A and 32B.
Figure 11:
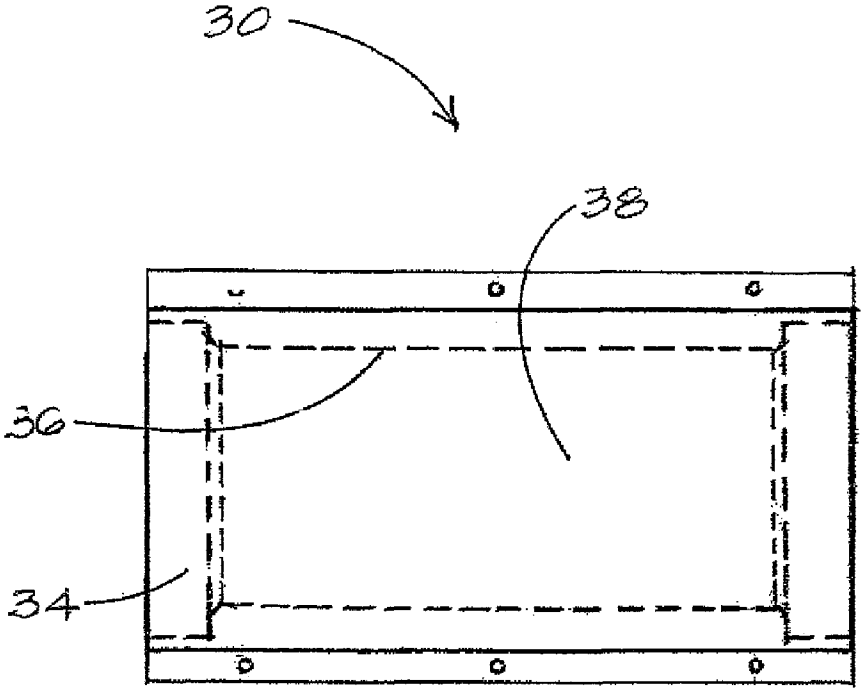
FIG. 11 is a side elevation view of a compression coupler 30 of the interlinking tension/compression member 10 of FIG. 9.
Figures 12, 12A, 12B:
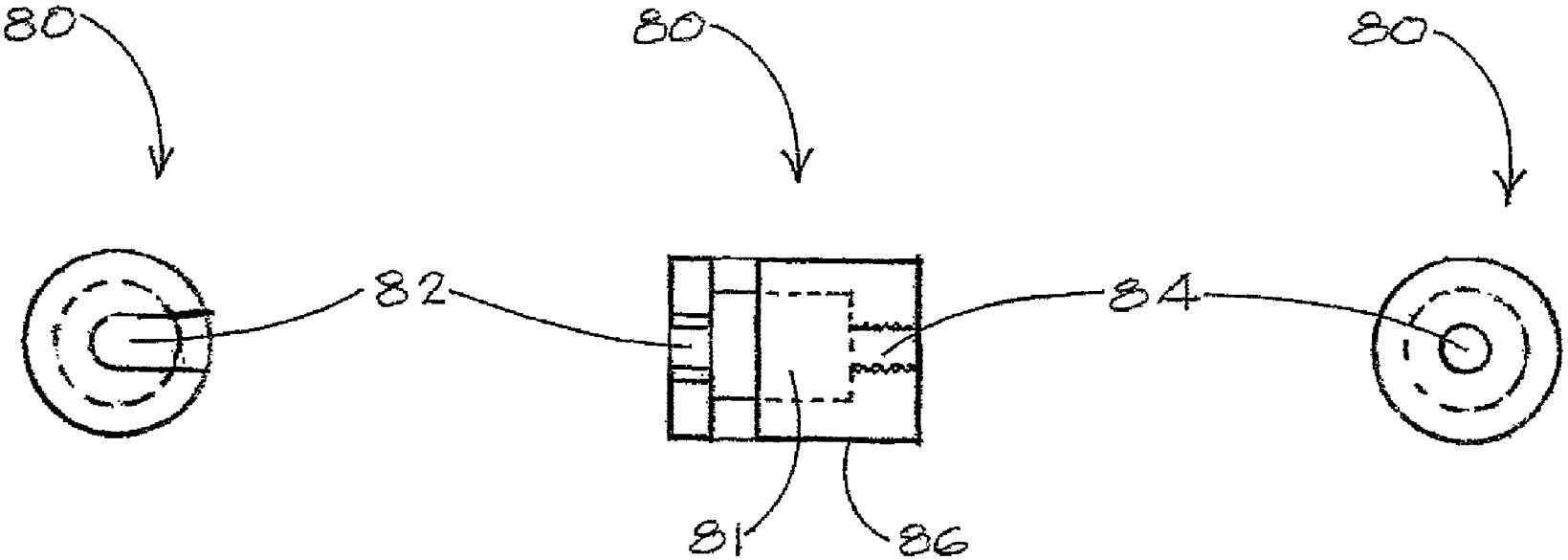
FIG. 12 is a side elevation view of a turnbuckle 80 of the interlinking tension/compression member 10 of FIG. 9.
FIG. 12A is a left end elevation view of the turnbuckle 80 of FIG. 12 including a keyed opening 82.
FIG. 12B is a right end elevation view of the turnbuckle 80 of FIG. 12 including a threaded opening 84.
Figures 13, 13A, 13B:
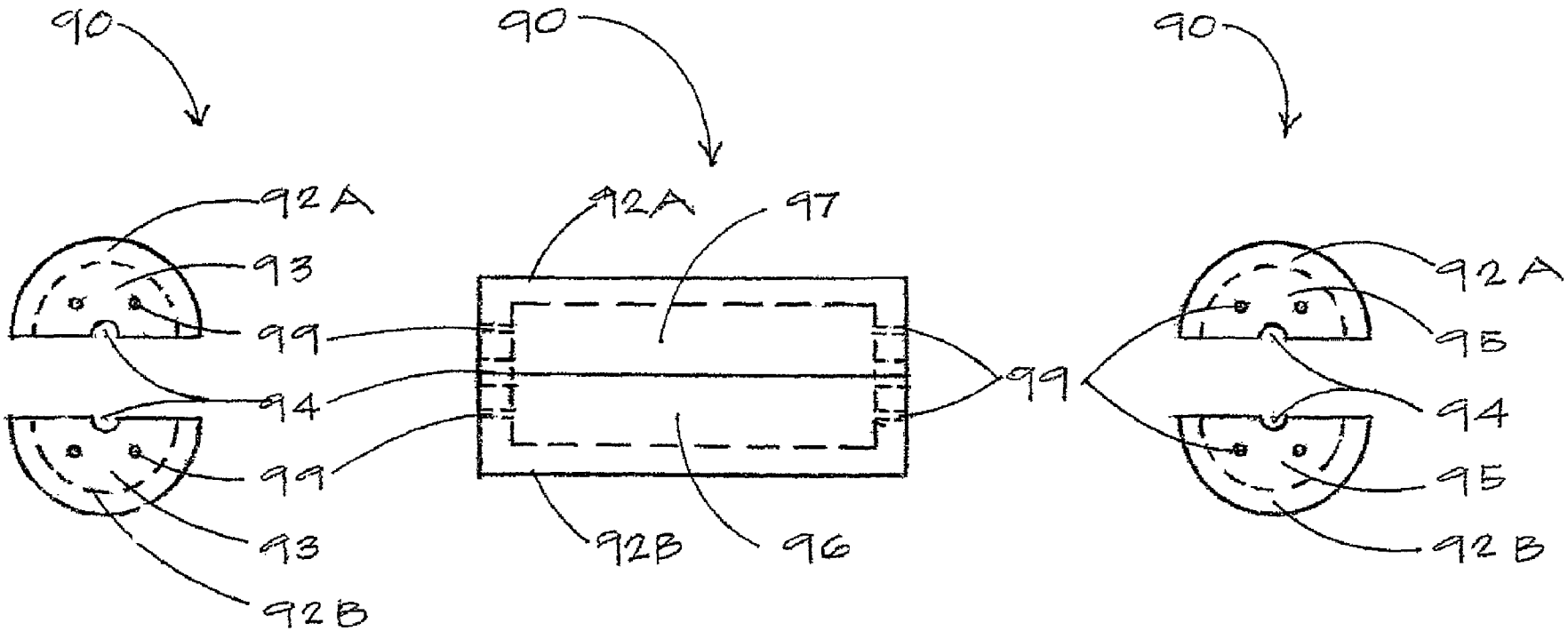
FIG. 13 is a side elevation view of a tension coupler 90 of the interlinking tension/compression member 10 of FIG. 9.
FIG. 13A is an exploded left end view of the tension coupler 90 of FIG. 13 including two equal sized split annular flange portions 92A and 92B.
FIG. 13B is an exploded right end view of the tension coupler 90 of FIG. 13 including two equal sized split annular flange portions 92A and 92B.

With reference to drawing FIGS. 1-13B, a terraced structured land joint and assembly for structured land is presented. An embodiment of he land joint and assembly includes a plurality of ball joints 20A having outer surfaces, each ball joint having a plurality of monolithic mortises 74 of even diameter disposed on the ball joint outer surface 26 at predetermined locations and angles, each such monolithic mortise having a monolithic tension member 70 of predetermined diameter centered in each mortise 74 and extending orthogonally therefrom for a predetermined length along a longitudinal axis and having a swelled end portion 72, FIGS. 6, 9 and 9A. A second embodiment of the land joint and assembly further includes a plurality of ball joints 20B having outer surfaces, each ball joint having a plurality of monolithic tenons 24 disposed on the ball joint outer surface 26 at predetermined locations and angles, each such monolithic node having a monolithic tension member 70 of predetermined diameter centered on the tenon 24 and extending orthogonally therefrom for a predetermined length along a longitudinal axis and having a swelled end portion 72, FIGS. 7, 8, 9, and 9A.

An embodiment of the land joint and assembly further includes: a) a plurality of compression members 40 of predetermined length defining a uniform compression member cross-sectional area and uniform compression member interior volume 44 for receiving and housing at least one tension member 50, and having two compression ends sized to receive a monolithic ball joint tenon 24, FIGS. 7-9B; b) a plurality of tension members 50 of predetermined length along a longitudinal axis, at least one first tension member having two equal sized swelled end portions 52 of even diameters and orthogonally disposed to the tension member longitudinal axis, a diameter of uniform cross-sectional area between the swelled end portions 52, and a third, larger swelled portion 54 proximal to one of the smaller, swelled end portions 52 and orthogonally disposed to the tension member longitudinal axis, and at least one second tension member having two unequal sized swelled end portions of different diameters orthogonally disposed to the second tension member longitudinal axis, a diameter of uniform cross-sectional area between the swelled end portions, the larger end portion 53 having a threaded extension 55 along the second tension member longitudinal axis, each such tension member sized to be housed within a compression member interior 44; c) a plurality of first tension coupling means 100 sized to reside within a compression member interior 40 and to couple one first tension member swelled end portion 52 without orthogonally threaded extension to a monolithic tension member swelled end portion 72; d) a plurality of turn buckle assemblies 80 sized to reside within a compression member interior 44 and to adjustably couple and house one second tension member larger swelled end portion 53 with threaded member 55 to a first tension member smaller swelled end portion 52; e) a plurality of second tension coupling assemblies 90 sized to reside within a compression member interior 44 and to house one turn buckle assembly 80 coupling a first tension member smaller swelled end portion 52 to a second tension member threaded member 55, and further house and connect one larger tension member swelled end portion 54 to a second larger tension member swelled end portion 53; and f) a plurality of compression coupling assemblies 30 sized to connect and house a first compression member end 42 and a second compression member end 42; whereby the plurality of ball joints 20, tension members 50, and compression members 40, coupling assemblies 90 and 100, and turn buckle assemblies 80 provide at least one assembly for space frame 600, at least one assembly for horizontal support 700 of at least one assembly for space frame 600, and at least one assembly for vertical support 800 of at least one assembly for horizontal support 700 of at least one assembly for space frame 600. The tension member smaller swelled end portions 52 are approximately the same size as the monolithic tension stub swelled end portion 72. The tension member larger swelled end portions 53 and 54 are approximately the same size.

In an embodiment of the terraced structured land joint and assembly for structured land, each first tension coupling assembly 100 includes two equal sized split annular flange portions 102A and 102B, each split portion including an outer radius defining two, small semi-circle openings 104 sized to receive the tension member 50 and tension member 70 diameters of approximately the same uniform cross-sectional area between the smaller sized swelled end portion 52 and larger sized swelled end portion 54, and monolithic tenon 24 and monolithic tension stub swelled end portion 72, respectively, FIGS. 9, 9A, 10, and 10A. Each first tension coupling assembly 100 further includes an inner radius defining a second, large semi-circle opening 106 sized to receive the smaller tension member swelled end portion 52 and monolithic tension stub swelled end portion 72 diameters. Each first tension coupling assembly 100 further includes top 108 and bottom 110 faces having corresponding openings 112 sized to receive fasteners to join and secure the split annular flange portions. 102A and 102B. When joined, the faces 108 and 110 are flush. The two, small semi-circle openings 104 receive and secure the tension member diameters of two opposing tension members. The second, large semi-circle opening 106 receives and secures tension member swelled end portions 52 and 72 of two opposing tension members 50 and 70. In this fashion, the tension forces along the tension members' longitudinal axes are transferred from one tension member to the other tension member through the first tension coupling means 100.

In an embodiment of the terraced structured land joint and assembly for structured land, each turn buckle assembly 80 includes a flanged cylinder 86 having an interior recess 81 sized to receive and hold a tension member small swelled end portion 52. The turn buckle assembly further includes a threaded opening 84 on one end corresponding to the tension member threaded extension 55 to adjustably tighten the tension member 50. The turnbuckle assembly 80 further includes a keyed opening 82 on the other end swelled end portion sized to accept the tension members 50 and 60 uniform cross-sectional areas between swelled end portions 54 and 52 and 53 and 52, respectively, while securing the smaller swelled end portion 52 within the flanged cylinder interior recess 81, FIGS. 9-9B, and 12-12B.

In an embodiment of the terraced structured land joint and assembly for structured land, each second tension coupling assembly 90 includes two equal sized split annular flange portions 92A and 92B, each split portion including an outer radius defining two, small semi-circle openings 94 sized to receive the tension member 50 diameters of approximately the same uniform cross-sectional area between the smaller sized swelled end portion 52 and larger sized swelled end portion 54, FIGS. 9-9B, and 13-13B. The second tension coupling assembly 90 further includes split portion faces 93 and 95, and an inner radius 96 defining a second, large semi-circle opening 97 sized to receive and house at least one turnbuckle assembly, 80, and tension member large swelled end portions, 53 and 54. Corresponding openings 99 sized to receive fasteners to join and secure the split annular flange face portions, 93 and 95, to tension member large swelled end portions, 53 and 54, housed within the second tension coupling assembly 90. When joined, the two, small semi-circle openings 94 receive and secure the tension member diameters of two opposing tension members 50 and 60 engaged within the turnbuckle assembly 80. The second, large semi-circle opening 97 houses the turnbuckle assembly 80. The tension member large swelled end portions, 53 and 54, are secured by fasteners to the faces, 93 and 95, such that tension forces along the tension members' longitudinal axes are transferred from one tension member 50 to the other tension member 60 through the second tension coupling assembly 90.

All elements of the terraced structured land joint and assembly for structured land are manufactured from metals, advanced carbon fibers, including buckyballs, buckytubes and other nano-fiber graphenes and fullerenes, and other advanced structural composites.

Figure 2:
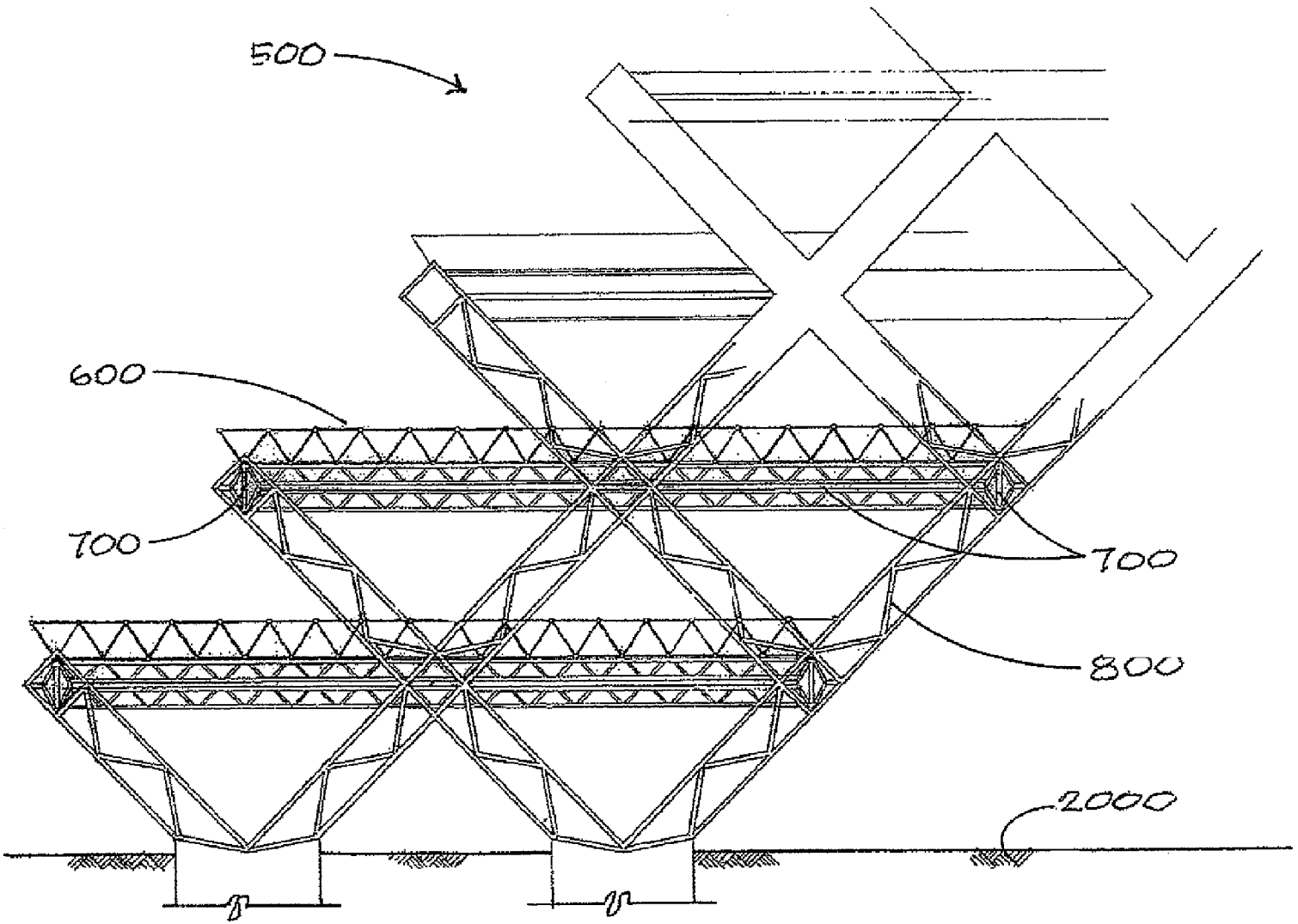
FIG. 2 is an expanded detail, front elevation view of the representative structured land 1000 of FIG. 1, including a plurality of modules 500, each such module 500 having a plurality of planar space frames 600, a plurality of horizontal truss members 700, and a plurality of vertical truss members 800.
Figure 3:
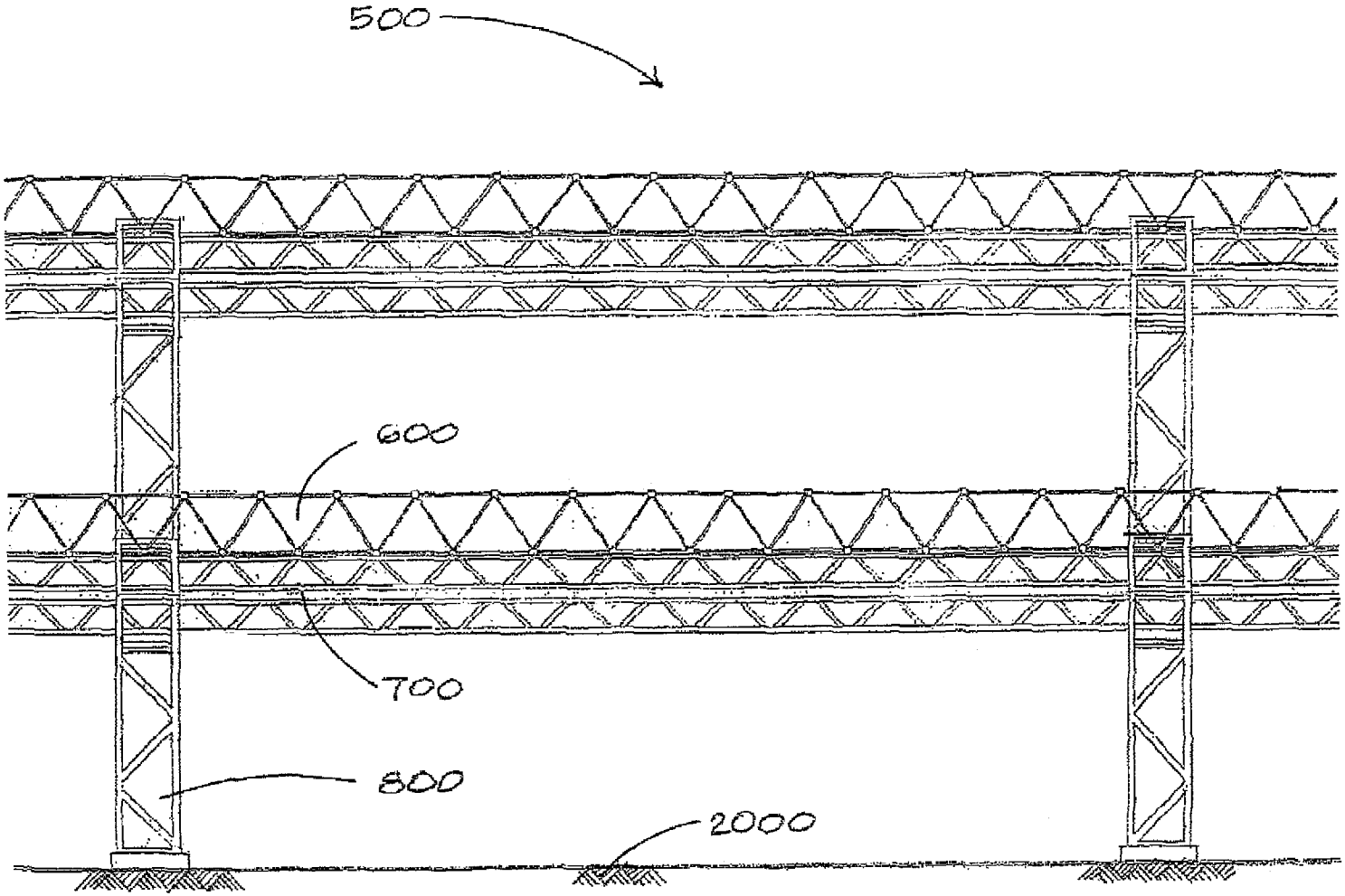
FIG. 3 is a is a side elevation view of the representative structured land 1000 of FIG. 2, including a plurality of modules 500, each such module 500 having a plurality of planar space frames 600, a plurality of horizontal truss members 700, and a plurality of vertical truss members 800.
Figure 4:
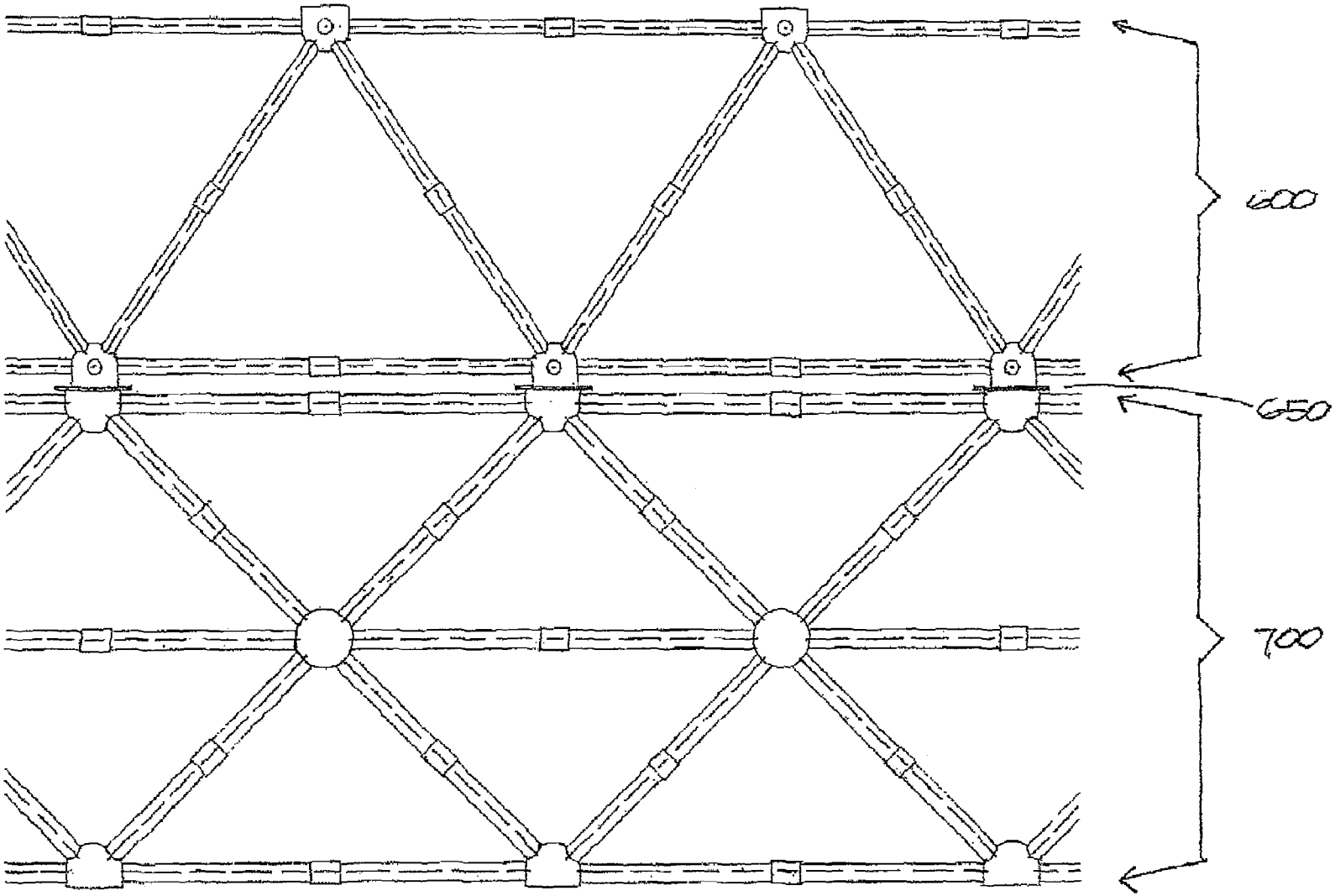
FIG. 4 is an expanded detail, side elevation view of the representative structured land 1000 of FIG. 3, including a plurality of modules 500, each such module 500 having a plurality of planar space frames 600, a plurality of horizontal truss members 700, and a plurality of vertical truss members 800, and including the interface 650 between space frames 600 and horizontal truss members 700.
Figure 5:
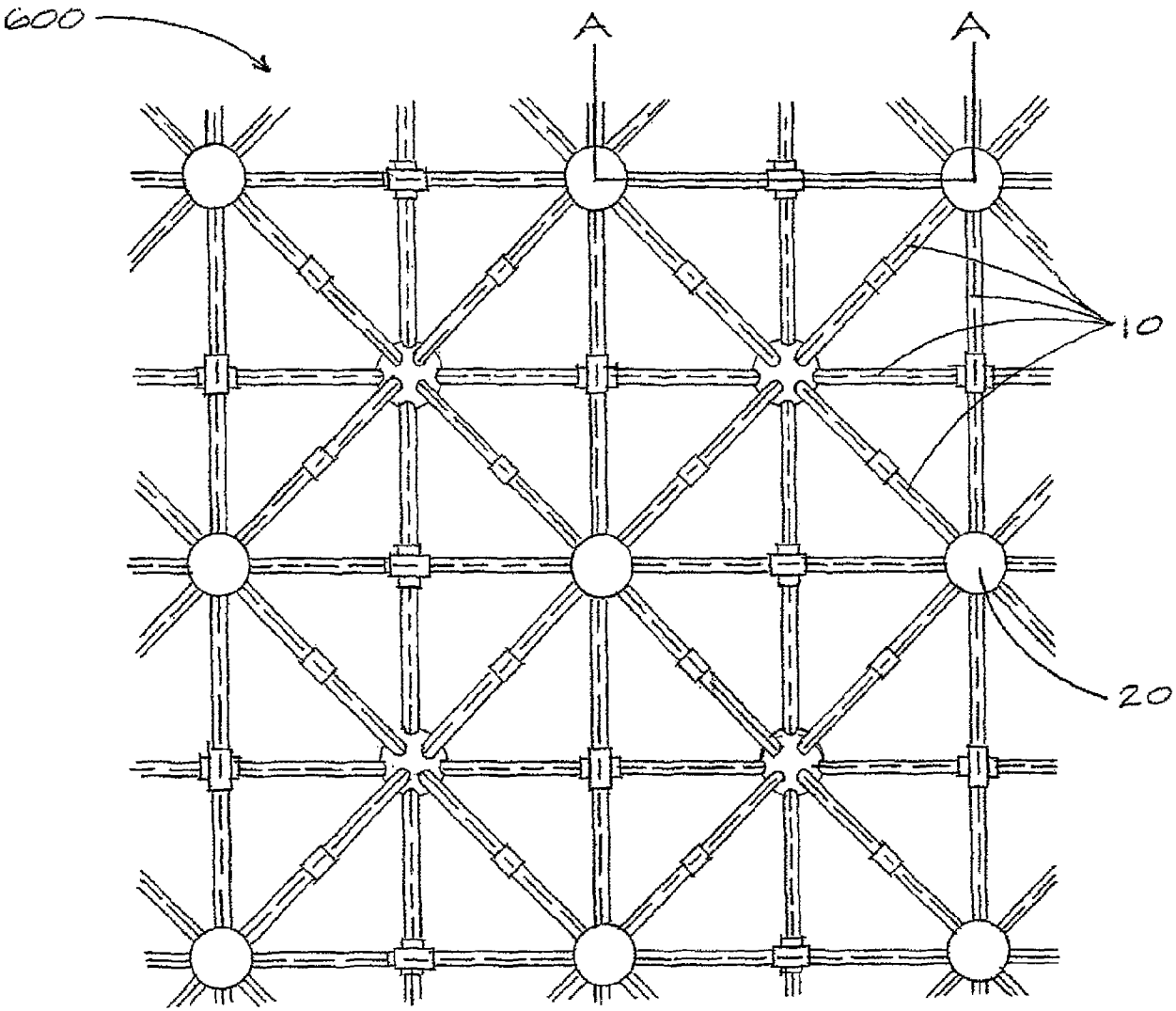
FIG. 5 is a top view of a representative planar space frame 600, including a plurality of ball joints 20 and a plurality of interlinking tension/compression members 10 connected to the ball joints 20.

As disclosed herein above, the terraced structured land joint and assembly for structured land can be assembled to provide an assembly for space frame 600, a horizontal support assembly 700 for supporting the assembly for space frame 600, and vertical support assembly 800 for transferring loads from the horizontal support assembly 700 to the earth 2000, FIG. 2.

The terraced structured land joint and assembly for structured land can include a series of interlocking chords and joints in a horizontal, planar geometric pattern, and wherein the cords and joints to provide an assembly for space frame 600, a horizontal support assembly 700 for supporting the assembly for space frame 600, and vertical support assembly 800 for transferring loads from the horizontal support assembly 700 to the earth 2000, FIGS. 1-5.

The terraced structured land joint and assembly for structured land further can include two member trusses consisting of modular length chords and joints, and wherein the cords and joints to provide an assembly for space frame 600, a horizontal support assembly 700 for supporting the assembly for space frame 600, and vertical support assembly 800 for transferring loads from the horizontal support assembly 700 to the earth 2000.

The terraced structured land joint and assembly for structured land further can include three member trusses consisting of modular length chords and joints, and wherein the cords and joints to provide an assembly for space frame 600, a horizontal support assembly 700 for supporting the assembly for space frame 600, and vertical support assembly 800 for transferring loads from the horizontal support assembly 700 to the earth 2000.

All connector parts and frame members of the terraced structured land joint and assembly for structured land are simply designed and are without complex formations. All of these elements can be cast or forged in simple two-part molds. Depending on structural requirements, these elements may be manufactured out of a range of materials from metals, advanced carbon fibers, including buckyballs, buckytubes and other nano-fiber graphenes and fullerenes, and other advanced structural composites.

Accordingly, any appropriate casting of forging method for metal components may be used in their manufacture. The fasteners and threaded members can be fabricated using forging techniques for metal components that are commonly used in the manufacture of high strength bolts, and related fasteners. Medium carbon alloy steels with protective coatings that resist corrosion are also highly suitable for fabricating the ball joints, monolithic mortices or tenons, and monolithic tension studs for certain applications. That portion of the ball joint in contact with compression members can additionally be finished to provide a low friction hardened surface.

By the foregoing disclosure, a highly structural, simply designed, economical to manufacture and assemble terraced structured land joint and assembly system is presented. The terraced structured land joint and assembly system disclosed herein demonstrates high flexibility of application and high economy of use. By incorporating the principles and features described herein, the improved terraced structured land joint and assembly system is capable of wide-ranging applications in common building construction. The preferred embodiment of the improved joint and assembly system is particularly suited to structured land and, as such, is useful in a wide spectrum of artificial land concepts and applications. The drawings and embodiments of the improved terraced structured land joint and assembly system are illustrative and should not be construed to limit the full range of possible variations which fall within the scope of the invention.

I claim:

1. Terraced structured land joint and assembly for structured land comprising, in combination:

a) a plurality of ball joints having outer surfaces, each ball joint having a plurality of monolithic tenons disposed on the ball joint outer surface at predetermined locations and angles, each such monolithic tenon having a monolithic tension member of predetermined diameter centered on the tenon and extending orthogonally therefrom for a predetermined length along a longitudinal axis and having a swelled end portion;

b) a plurality of compression members of predetermined length defining a uniform compression member cross-sectional area and uniform compression member interior volume for receiving and housing at least one tension member, and having two compression ends sized to receive and house a monolithic ball joint tenon;

c) a plurality of tension members of predetermined length along a longitudinal axis, at least one first tension member having a diameter of uniform cross-sectional area, two equal sized swelled end portions of even diameters and orthogonally disposed to the longitudinal axis, and a third, larger swelled portion proximal to one of the smaller, swelled end portions and orthogonally disposed to the longitudinal axis, and at least one second one tension member having a diameter of uniform cross-sectional area, one smaller swelled end portion orthogonally disposed to the longitudinal axis and one larger swelled end portion orthogonally disposed to the longitudinal axis and having a threaded extension along the longitudinal axis, each such tension member sized to be housed within a compression member interior;

d) a plurality of means for first tension coupling sized to reside within an compression member interior and to couple one first tension member swelled end portion without threaded extension to a monolithic tension member swelled end portion;

e) a plurality of means for turn buckle sized to reside within a compression member interior and to couple and house one second tension member swelled end portion with threaded member to a first tension member swelled end portion;

f) a plurality of means for second tension coupling sized to reside within a compression member interior and to house one turn buckle coupling a first tension member swelled end portion to a second tension member swelled end portion with threaded member; and g) a plurality of means for compression coupling sized to connect and house a first compression member end and a second compression member end;

whereby the plurality of ball joints, tension members, and compression members, means for first tension coupling, means for second tension coupling, means for compression coupling, and means for turn buckle are assembled to provide at least one means for space frame, at least one means for horizontal support of at least one means for space frame, and at least one means for vertical support of at least one means for horizontal support of at least one means for space frame.

2. The assembly of claim 1, wherein each means for first tension coupling comprises two equal sized split annular flange portions, each split annular flange portion comprising:

a) an outer radius defining two, small semi-circle openings sized to receive the tension member diameter of uniform cross-sectional area between swelled end portions;

b) an inner radius defining a second, large semi-circle opening sized to receive the tension member swelled end portion diameter; and c) top and bottom faces having corresponding openings sized to receive fastener means to join and secure the split annular flange portions such that when joined the faces are flush, arid the two, small semi-circle openings receive and secure the tension member diameters of two opposing tension members, and the second, large semi-circle opening receives and secures tension member swelled end portions of two opposing tension members such that tension forces along the tension members' longitudinal axes are transferred from one tension member to the other tension member through means for first tension coupling.

3. The assembly of claim 1, wherein each means for turn buckle comprises:

a) a flanged cylinder having an interior recess sized to receive and hold a tension member swelled end portion;

b) a threaded opening on one end corresponding to the tension member threaded extension; and c) a keyed opening on the other end swelled end portion sized to accept the tension member uniform cross-sectional area between swelled end portions while securing one swelled end portion within the flanged cylinder interior recess.

4. The assembly of claim 1, wherein each means for second tension coupling comprises two equal sized split annular flange portions, each split annular flange portion comprising:

a) an outer radius defining two, small semi-circle openings sized to receive the tension member diameter of uniform cross-sectional area between swelled end portions and defining split portion faces;

b) an inner radius defining a second, large semi-circle opening sized to receive at least one means for turn buckle;

c) corresponding openings sized to receive fastener means to join and secure the split annular flange portions to tension member end portions housed within the at least one means for turn buckle within means for second tension coupling such that when joined the split portion faces are flush one against the other, the two, small semi-circle openings receive and secure the tension member diameters of two opposing tension members engaged with means for turn buckle, and the second, large semi-circle opening receives and secures means for turn buckle such that tension forces along the tension members' longitudinal axes are transferred from one tension member to the other tension member through means for second tension coupling.

5. The assembly of claim 1, wherein each means for compression coupling comprises two equal sized split annular flange portions, each split annular flange portion comprising:

a) an outer radius defining two, semi-circle openings sized to receive the compression member diameter of uniform cross-sectional area b) an inner radius defining a second, semi-circle opening sized smaller than the compression member diameter to receive and transfer compression member forces through the means for compression coupling; and c) top and bottom faces having corresponding openings sized to receive fastener means to join and secure the split annular flange portions such that when joined the faces are flush, the two semi-circle openings receive and secure the compression member diameters of two opposing compression members, and the second, smaller semi-circle openings receive and secure compression member end portions of two opposing compression members such that compression forces along the compression members longitudinal axes are transferred from one compression member to the other compression member through the means for compression coupling.

6. The assembly of claim 1, wherein all elements are manufactured from the group consisting of metals, advanced carbon fibers, including buckyballs, buckytubes and other nanofiber graphenes and fullerenes, and other structural composites.

7. Terraced structured land joint and assembly for structured land comprising, in combination:

a) a plurality of ball joints having outer surfaces, each ball joint having a plurality of monolithic mortises disposed on the ball joint outer surface at predetermined locations and angles, each such monolithic mortise having a monolithic tension member of predetermined diameter centered in the mortise and extending orthogonally therefrom for a predetermined length along a longitudinal axis and having a swelled end portion;

b) a plurality of compression members of predetermined length defining a uniform compression member cross-sectional area and uniform compression member interior volume for receiving and housing at least one tension member, and having two compression ends sized to engage and reside within a monolithic ball joint mortise;

c) a plurality of tension members of predetermined length along a longitudinal axis, at least one first tension member having a diameter of uniform cross-sectional area, two equal sized swelled end portions of even diameters and orthogonally disposed to the longitudinal axis, and a third, larger swelled portion proximal to one of the smaller, swelled end portions and orthogonally disposed to the longitudinal axis, and at least one second one tension member having a diameter of uniform cross-sectional area, one smaller swelled end portion orthogonally disposed to the longitudinal axis and one larger swelled end portion orthogonally disposed to the longitudinal axis and having an threaded extension along the longitudinal axis, each such tension member sized to be housed within a compression member interior;

d) a plurality of means for first tension coupling sized to reside within a compression member interior and to couple one first tension member swelled end portion without threaded extension to a monolithic tension stub swelled end portion;

e) a plurality of means for turn buckle sized to reside within a compression member interior and to couple and house one second tension member swelled end portion with threaded member to a first tension member swelled end portion;

f) a plurality of means for second tension coupling sized to reside within an compression member interior and to house one turn buckle coupling a first tension member swelled end portion to a second tension member swelled end portion with threaded member; and g) a plurality of means for compression coupling sized to connect and house a first compression member end and a second compression member end;

whereby the plurality of ball joints, tension members, and compression members, means for first tension coupling, means for second tension coupling, means for compression coupling, and means for turn buckle are assembled to provide at least one means for space frame, at least one means for horizontal support of at least one means for space frame, and at least one means for vertical support of at least one means for horizontal support of at least one means for space frame.

8. The assembly of claim 7, wherein each means for first tension coupling comprises two equal sized split annular flange portions, each split annular flange portion comprising:

a) an outer radius defining two, small semi-circle openings sized to receive the tension member diameter of uniform cross-sectional area between swelled end portions;

b) an inner radius defining a second, large semi-circle opening sized to receive the tension member swelled end portion diameter; and c) top and bottom faces having corresponding openings sized to receive fastener means to join and secure the split annular flange portions such that when joined the faces are flush, the two, small semi-circle openings receive and secure the tension member diameters of two opposing tension members, and the second, large semi-circle opening receives and secures tension member swelled end portions of two opposing tension members such that tension forces along the tension members' longitudinal axes are transferred from one tension member to the other tension member through the means for first tension coupling.

9. The assembly of claim 7, wherein each means for turn buckle comprises:

a) a flanged cylinder having an interior recess sized to receive and hold a tension member swelled end portion;

b) a threaded opening on one end corresponding to the tension member threaded extension; and c) a keyed opening on the other end swelled end portion sized to accept the tension member uniform cross-sectional area between swelled end portions while securing one swelled end portion within the flanged cylinder interior recess.

10. The assembly of claim 7, wherein each means for second tension coupling comprises two equal sized split annular flange portions, each split annular flange portion comprising:

a) an outer radius defining two, small semi-circle openings sized to receive the tension member diameter of uniform cross-sectional area between swelled end portions and defining split portion faces;

b) an inner radius defining a second, large semi-circle opening sized to receive at least one means for turn buckle;

c) corresponding openings sized to receive fastener means to join and secure the split annular flange portions to tension member end portions housed within the at least one means for turn buckle within the means for second tension coupling such that when joined the split portion faces are flush one against the other, and the two, small semi-circle openings receive and secure the tension member diameters of two opposing tension members engaged with the turnbuckle means, and the second, large semi-circle opening receives and secures the means for turn buckle such that tension forces along the tension members' longitudinal axes are transferred from one tension member to the other tension member through the means for second tension coupling.

11. The assembly of claim 7, wherein each means for compression coupling comprises two equal sized split annular flange portions, each split annular flange portion comprising:

a) an outer radius defining two, semi-circle openings sized to receive the compression member diameter of uniform cross-sectional area;

b) an inner radius defining a second, semi-circle opening sized smaller than the compression member diameter to receive and transfer compression member forces through means for first tension coupling and means for second tension coupling; and c) top and bottom faces having corresponding openings sized to receive fastener means to join and secure the split annular flange portions such that when joined the faces are flush, the two semi-circle openings receive and secure the compression member diameters of two opposing compression members, and the second, smaller semi-circle openings receive and secure compression member end portions of two opposing compression members such that compression forces along the compression members longitudinal axes are transferred from one compression member to the other compression member through means for compression coupling.

12. The assembly of claim 7, wherein all elements are manufactured from the group consisting of metals, advanced carbon fibers, including buckyballs, buckytubes and other nano-fiber graphenes and fullerenes, and other structural composites.

13. A structured land system, comprising:

a) means for space frame;

b) horizontal support means for supporting means for space frame; and c) vertical support means for transferring loads from said horizontal support means for supporting means for space frame to the earth, wherein said means for space frame comprises a series of interlocking chords and joints in a horizontal, planar geometric pattern, and wherein the cords and joints comprise, in combination:

i) a plurality of ball joints having outer surfaces, each ball joint having a plurality of monolithic tenons disposed on the ball joint outer surface at predetermined locations and angles, each such monolithic tenon having a monolithic tension member of predetermined diameter centered on the tenon and extending orthogonally therefrom for a predetermined length along a longitudinal axis and having a swelled end portion;

ii) a plurality of compression members of predetermined length defining a uniform compression member cross-sectional area and uniform compression member interior volume for receiving and housing at least one tension member, and having two compression ends sized to receive a monolithic ball joint tenon;

iii) a plurality of tension members of predetermined length along a longitudinal axis, at least one first tension member having a diameter of uniform cross-sectional area, two equal sized swelled end portions of even diameters and orthogonally disposed to the longitudinal axis, and a third, larger swelled portion proximal to one of the smaller, swelled end portions and orthogonally disposed to the longitudinal axis, and at least one second one tension member having a diameter of uniform cross-sectional area, one smaller swelled end portion orthogonally disposed to the longitudinal axis and one larger swelled end portion orthogonally disposed to the longitudinal axis and having an threaded extension along the longitudinal axis, each such tension member sized to be housed within a compression member interior;

iv) a plurality of means for first tension coupling sized to reside within a compression member interior and to couple one first tension member swelled end portion without threaded extension to a monolithic tension stub swelled end portion;

v) a plurality of means for turn buckle sized to reside within a compression member interior and to couple and house one second tension member swelled end portion with threaded member to a first tension member swelled end portion;

vi) a plurality of means for second tension coupling sized to reside within an compression member interior and to house one turn buckle coupling a first tension member swelled end portion to a second tension member swelled end portion with threaded member; and vii) a plurality of means for compression coupling sized to connect and house a first compression member end and a second compression member end.

14. The system of claim 13, wherein horizontal support means for supporting means for space frame comprises two member trusses consisting of modular length chords and joints, and wherein the cords and joints comprise, in combination:

a) a plurality of ball joints having outer surfaces, each ball joint having a plurality of monolithic tenons disposed on the ball joint outer surface at predetermined locations and angles, each such monolithic tenon having a monolithic tension member of predetermined diameter centered on the tenon and extending orthogonally therefrom for a predetermined length along a longitudinal axis and having a swelled end portion;

b) a plurality of compression members of predetermined length defining a uniform compression member cross-sectional area and uniform compression member interior volume for receiving and housing at least one tension member, and having two compression ends sized to receive a monolithic ball joint tenon;

c) a plurality of tension members of predetermined length along a longitudinal axis, at least one first tension member having a diameter of uniform cross-sectional area, two equal sized swelled end portions of even diameters and orthogonally disposed to the longitudinal axis, and a third, larger swelled portion proximal to one of the smaller, swelled end portions and orthogonally disposed to the longitudinal axis, and at least one second one tension member having a diameter of uniform cross-sectional area, one smaller swelled end portion orthogonally disposed to the longitudinal axis and one larger swelled end portion orthogonally disposed to the longitudinal axis and having an threaded extension along the longitudinal axis, each such tension member sized to be housed within a compression member interior;

d) a plurality of means for first tension coupling sized to reside within a compression member interior and to couple one first tension member swelled end portion without threaded extension to a monolithic tension stub swelled end portion;

e) a plurality of means for turn buckle sized to reside within a compression member interior and to couple and house one second tension member swelled end portion with threaded member to a first tension member swelled end portion;

f) a plurality of means for second tension coupling sized to reside within an compression member interior and to house one turn buckle coupling a first tension member swelled end portion to a second tension member swelled end portion with threaded member; and g) a plurality of means for compression coupling sized to connect and house a first compression member end and a second compression member end.

15. The system of claim 13, wherein vertical support means for transferring loads from horizontal support means to the earth comprises three member trusses consisting of modular length chords and joints, and wherein the cords and joints comprise, in combination:

a) a plurality of ball joints having outer surfaces, each ball joint having a plurality of monolithic tenons disposed on the ball joint outer surface at predetermined locations and angles, each such monolithic tenon having a monolithic tension member of predetermined diameter centered on the tenon and extending orthogonally therefrom for a predetermined length along a longitudinal axis and having a swelled end portion;

b) a plurality of compression members of predetermined length defining a uniform compression member cross-sectional area and uniform compression member interior volume for receiving and housing at least one tension member, and having two compression ends sized to receive a monolithic ball joint tenon;

c) a plurality of tension members of predetermined length along a longitudinal axis, at least one first tension member having a diameter of uniform cross-sectional area, two equal sized swelled end portions of even diameters and orthogonally disposed to the longitudinal axis, and a third, larger swelled portion proximal to one of the smaller, swelled end portions and orthogonally disposed to the longitudinal axis, and at least one second one tension member having a diameter of uniform cross-sectional area, one smaller swelled end portion orthogonally disposed to the longitudinal axis and one larger swelled end portion orthogonally disposed to the longitudinal axis and having an threaded extension along the longitudinal axis, each such tension member sized to be housed within a compression member interior;

d) a plurality of means for first tension coupling sized to reside within a compression member interior and to couple one first tension member swelled end portion without threaded extension to a monolithic tension stub swelled end portion;

e) a plurality of means for turn buckle sized to reside within a compression member interior and to couple and house one second tension member swelled end portion with threaded member to a first tension member swelled end portion;

f) a plurality of means for second tension coupling sized to reside within an compression member interior and to house one turn buckle coupling a first tension member swelled end portion to a second tension member swelled end portion with threaded member; and g) a plurality of means for compression coupling sized to connect and house a first compression member end and a second compression member end.

16. The system of claim 13, wherein means for space frame comprises a series of interlocking chords and joints in a horizontal, planar geometric pattern, and wherein the cords and joints comprise, in combination:

a) a plurality of ball joints having outer surfaces, each ball joint having a plurality of monolithic tenons disposed on the ball joint outer surface at predetermined locations and angles, each such monolithic tenon having a monolithic tension member of predetermined diameter centered on the tenon and extending orthogonally therefrom for a predetermined length along a longitudinal axis and having a swelled end portion;

b) a plurality of compression members of predetermined length defining a uniform compression member cross-sectional area and uniform compression member interior volume for receiving and housing at least one tension member, and having two compression ends sized to receive a monolithic ball joint tenon;

c) a plurality of tension members of predetermined length along a longitudinal axis, at least one first tension member having a diameter of uniform cross-sectional area, two equal sized swelled end portions of even diameters and orthogonally disposed to the longitudinal axis, and a third, larger swelled portion proximal to one of the smaller, swelled end portions and orthogonally disposed to the longitudinal axis, and at least one second one tension member having a diameter of uniform cross-sectional area, one smaller swelled end portion orthogonally disposed to the longitudinal axis and one larger swelled end portion orthogonally disposed to the longitudinal axis and having an threaded extension along the longitudinal axis, each such tension member sized to be housed within a compression member interior;

d) a plurality of means for first tension coupling sized to reside within a compression member interior and to couple one first tension member swelled end portion without threaded extension to a monolithic tension stub swelled end portion;

e) a plurality of means for turn buckle sized to reside within a compression member interior and to couple and house one second tension member swelled end portion with threaded member to a first tension member swelled end portion;

f) a plurality of means for second tension coupling sized to reside within an compression member interior and to house one turn buckle coupling a first tension member swelled end portion to a second tension member swelled end portion with threaded member; and g) a plurality of means for compression coupling sized to connect and house a first compression member end and a second compression member end.

17. The system of claim 13, wherein horizontal support means for supporting means for space frame comprises two member trusses consisting of modular length chords and joints, and wherein the cords and joints comprise, in combination:

a) a plurality of ball joints having outer surfaces, each ball joint having a plurality of monolithic mortises disposed on the ball joint outer surface at predetermined locations and angles, each such monolithic mortises having a monolithic tension member of predetermined diameter centered on the tenon and extending orthogonally therefrom for a predetermined length along a longitudinal axis and having a swelled end portion;

b) a plurality of compression members of predetermined length defining a uniform compression member cross-sectional area and uniform compression member interior volume for receiving and housing at least one tension member, and having two compression ends sized to receive a monolithic ball joint tenon;

c) a plurality of tension members of predetermined length along a longitudinal axis, at least one first tension member having a diameter of uniform cross-sectional area, two equal sized swelled end portions of even diameters and orthogonally disposed to the longitudinal axis, and a third, larger swelled portion proximal to one of the smaller, swelled end portions and orthogonally disposed to the longitudinal axis, and at least one second one tension member having a diameter of uniform cross-sectional area, one smaller swelled end portion orthogonally disposed to the longitudinal axis and one larger swelled end portion orthogonally disposed to the longitudinal axis and having an threaded extension along the longitudinal axis, each such tension member sized to be housed within a compression member interior;

d) a plurality of means for first tension coupling sized to reside within a compression member interior and to couple one first tension member swelled end portion without threaded extension to a monolithic tension stub swelled end portion;

e) a plurality of means for turn buckle sized to reside within a compression member interior and to couple and house one second tension member swelled end portion with threaded member to a first tension member swelled end portion;

f) a plurality of means for second tension coupling sized to reside within an compression member interior and to house one turn buckle coupling a first tension member swelled end portion to a second tension member swelled end portion with threaded member; and g) a plurality of means for compression coupling sized to connect and house a first compression member end and a second compression member end.

18. The system of claim 13, wherein vertical support means for transferring loads from horizontal support means to the earth comprises three member trusses consisting of modular length chords and joints, and wherein the cords and joints comprise, in combination:

a) a plurality of ball joints having outer surfaces, each ball joint having a plurality of monolithic mortises disposed on the ball joint outer surface at predetermined locations and angles, each such monolithic mortises having a monolithic tension member of predetermined diameter centered on the tenon and extending orthogonally therefrom for a predetermined length along a longitudinal axis and having a swelled end portion;

b) a plurality of compression members of predetermined length defining a uniform compression member cross-sectional area and uniform compression member interior volume for receiving and housing at least one tension member, and having two compression ends sized to receive a monolithic ball joint tenon;

c) a plurality of tension members of predetermined length along a longitudinal axis, at least one first tension member having a diameter of uniform cross-sectional area, two equal sized swelled end portions of even diameters and orthogonally disposed to the longitudinal axis, and a third, larger swelled portion proximal to one of the smaller, swelled end portions and orthogonally disposed to the longitudinal axis, and at least one second one tension member having a diameter of uniform cross-sectional area, one smaller swelled end portion orthogonally disposed to the longitudinal axis and one larger swelled end portion orthogonally disposed to the longitudinal axis and having an threaded extension along the longitudinal axis, each such tension member sized to be housed within a compression member interior;

d) a plurality of means for first tension coupling sized to reside within a compression member interior and to couple one first tension member swelled end portion without threaded extension to a monolithic tension stub swelled end portion;

e) a plurality of means for turn buckle sized to reside within a compression member interior and to couple and house one second tension member swelled end portion with threaded member to a first tension member swelled end portion;

f) a plurality of means for second tension coupling sized to reside within an compression member interior and to house one turn buckle coupling a first tension member swelled end portion to a second tension member swelled end portion with threaded member; and g) a plurality of means for compression coupling sized to connect and house a first compression member end and a second compression member end.

19. The system of claim 13, wherein all elements are manufactured from the group consisting of metals, advanced carbon fibers, including buckyballs, buckytubes and other nanofiber graphenes and fullerenes, and other structural composites.

* * * * *